US007350783B2

(12) United States Patent
Tevolini

(10) Patent No.: US 7,350,783 B2
(45) Date of Patent: Apr. 1, 2008

(54) CARD GAME AND METHOD OF PLAYING THE SAME

(76) Inventor: Ferdinando Tevolini, 475 Hoyt Farm Rd., New Canaan, CT (US) 06840

( * ) Notice: Subject to any disclaimer, the term of this patent is extended or adjusted under 35 U.S.C. 154(b) by 325 days.

(21) Appl. No.: 11/253,441

(22) Filed: Oct. 18, 2005

(65) Prior Publication Data

US 2007/0085272 A1 Apr. 19, 2007

(51) Int. Cl.
*A63F 1/00* (2006.01)

(52) U.S. Cl. ..... 273/292; 273/299; 273/300; 273/274; 463/12; 463/13; D21/379

(58) Field of Classification Search ..... 273/292, 273/299–307, 274; 463/12, 13; D21/379; 434/205, 207, 209
See application file for complete search history.

(56) References Cited

U.S. PATENT DOCUMENTS

| | | | | |
|---|---|---|---|---|
| 1,409,035 | A * | 3/1922 | Smith | 273/306 |
| 5,417,432 | A * | 5/1995 | Dwyer | 273/299 |
| 5,603,501 | A * | 2/1997 | Hayes | 273/272 |
| 5,613,682 | A | 3/1997 | Otuzbiryan | 273/292 |
| 5,788,241 | A * | 8/1998 | Ung | 273/292 |
| 5,810,663 | A | 9/1998 | Bochichio et al. | 463/13 |
| 6,511,072 | B1 | 1/2003 | Santa Cruz et al. | 273/292 |
| 6,523,831 | B2 | 3/2003 | Webb | 273/292 |
| 6,733,012 | B2 | 5/2004 | Bui et al. | 273/292 |
| 2002/0190468 | A1 | 12/2002 | Tchilinguirian | 273/292 |
| 2005/0029740 | A1 | 2/2005 | Ollington | 273/274 |
| 2005/0029746 | A1 | 2/2005 | O'Toole | 273/292 |

* cited by examiner

*Primary Examiner*—Benjamin Layno
(74) *Attorney, Agent, or Firm*—St. Onge Steward Johnston & Reens LLC

(57) ABSTRACT

Disclosed is a method of playing a card game, including the steps of providing a deck including three like sets of numbered cards, each set including a null card; receiving a first wager from each of a group of players; dealing three cards of the deck to each player; collecting two of each player's three cards; dealing two cards of the deck to each player; summing the numbers on the three cards for each player not holding a null card; providing at least a portion of the wagers to each player having the lowest sum; providing at least a portion of the wagers to each player having the highest sum; and providing a bonus to a player having three null cards.

22 Claims, 5 Drawing Sheets

CARD GAME AND METHOD OF PLAYING THE SAME

FIELD OF THE INVENTION

The invention relates to card games, and more specifically to a casino card game for multiple players using a specialized deck of cards, and method of playing the same.

BACKGROUND OF THE INVENTION

Playing cards, as they are known today, have origins back to at least as early as the $13^{th}$ century. Generally a deck of playing cards has fifty-two cards including thirteen ranks of each of four suits, spades, hearts, diamonds and clubs. Each suit includes an ace depicting a single symbol of its suit; a king, queen, and jack, each depicted with a symbol of its suit; and numbered cards two through ten, with each card depicting that many symbols (pips) of its suit. Two Jokers are included in commercial decks but many games require one or both to be removed before play.

The majority of known card games, whether for recreation or for casino play, utilizes traditional playing cards. Furthermore, in many known card games in which a group of players play against one other, there is only one winner of each hand. In poker, for example, the objective of each player is to win the entire pot which is the money that accumulates as players who remain in the game keep raising their bets.

With the expansion of the gaming industry and casinos in the United States, there is a need to offer a wider variety of games. It is therefore desired to provide a card game which departs from the traditional fifty-two card deck. It is further desired to provide a card game having multiple ways to win in a given hand. It is further desired to provide a card game in which two or more players may win in each hand.

SUMMARY OF THE INVENTION

According, it is an object of the present invention to provide a new card game employing a specialized deck of cards.

It is a further object to provide a card game in which includes multiple ways to win and multiple pots that can be independently won by different players in the same game.

It is a further object to provide such a card game for recreational use and for use by the gaming industry.

These and other objectives are achieved by providing a card game, comprising a first set of fourteen numbered cards, wherein each card has a distinct number between zero and thirteen, inclusive; a second set of fourteen numbered cards, wherein each card has a distinct number between zero and thirteen, inclusive; a third set of fourteen numbered cards, wherein each card has a distinct number between zero and thirteen, inclusive; and an instruction card.

Further provided is a method of playing a card game, comprising the steps of providing a deck including three like sets of numbered cards, each set including a null card, receiving a first wager from each of a group of players, dealing three cards of the deck to each player, collecting two of each player's three cards, dealing two cards of the deck to each player, summing the numbers on the three cards for each player not holding a null card; providing at least a portion of the wagers to each player having the lowest sum, and providing at least a portion of the wagers to each player having the highest sum.

Further provided is a method of playing a card game, comprising the steps of providing a deck including three like sets of numbered cards, each set including a null card, receiving a first wager from each of a group of players, receiving a bonus wager for a progressive bonus pot from at least one of the group of players, dealing three cards of the deck to each player; collecting two of each player's three cards, dealing two cards of the deck to each player, receiving a final wager from one or more of the group of players, discarding the three cards of each player not providing the final wager, summing the numbers on the three cards for each remaining player not holding a null card, providing at least a portion of the first and final wagers to each remaining player having the lowest sum, and providing at least a portion of the first and final wagers to each remaining player having the highest sum.

DETAILED DESCRIPTION OF THE INVENTION

Figure 1:
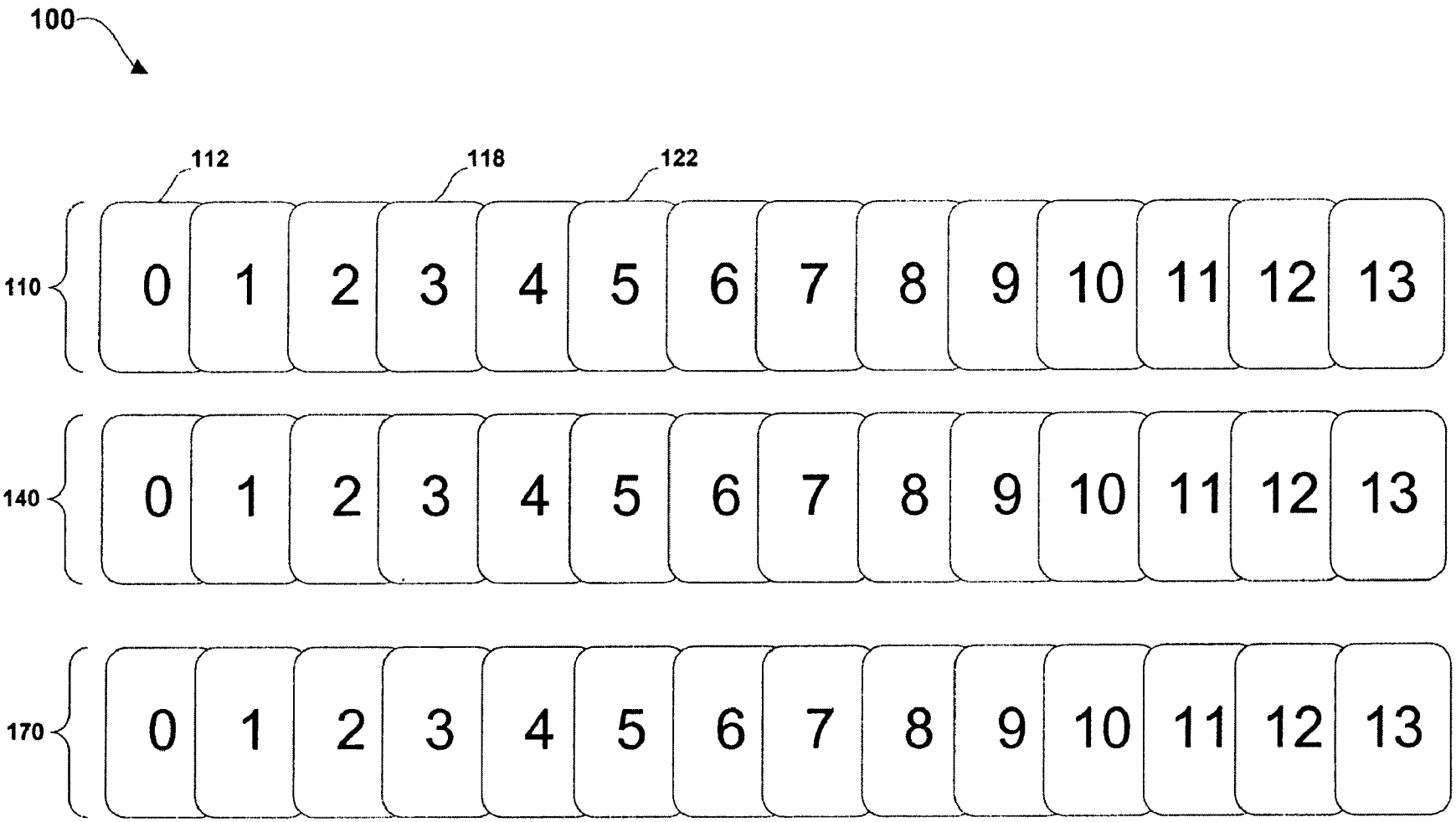
FIG. 1 is a diagram of a card game according to the present invention.

FIG. 1 shows a diagram of the card game 100 according to the present invention. The card game 100 includes like sets of numbered cards, e.g., set 110, set 140, and set 170. The sets 110, 140, and 170 collectively form a deck for playing the card game 100.

Each set includes a plurality of numbered cards, e.g., card 118, card 122, etc. Each set includes one null card 112. The null card 112 may include the number zero, as shown in FIG. 1, no number at all, and/or any symbol representing no measurable or otherwise determinable numeric value. In one embodiment of the card game 100, each set includes fourteen numbered cards (i.e., 42 cards in total), each card having a distinct number between zero and thirteen, inclusive. This embodiment may be played by any number of players, but preferably by a group that consists of up to eight players.

In another embodiment of the card game 100, each set includes seventeen numbered cards (i.e., 51 cards in total), each card having a distinct number between zero and sixteen, inclusive. This embodiment may also be played by any number of players, but preferably by a group that consists of up to ten players. The card game 100 may further include instructions and/or an instruction card (not shown).

In some other embodiments, the card game 100 includes more than three like sets of cards (e.g., four sets, five sets, etc). As one of ordinary skill in the art will understand, the number of sets and number of cards in each set may be increased or decreased (e.g., 10 cards per set, 19 cards per set, etc.) as necessary to keep the odds of winning similar for any number of players. In a preferred embodiment, at least a substantial portion of the cards of the deck are dealt by the end of each given hand. Therefore, the number of sets and number of cards may be varied in any manner than maintains a probability of such results.

Figure 2:
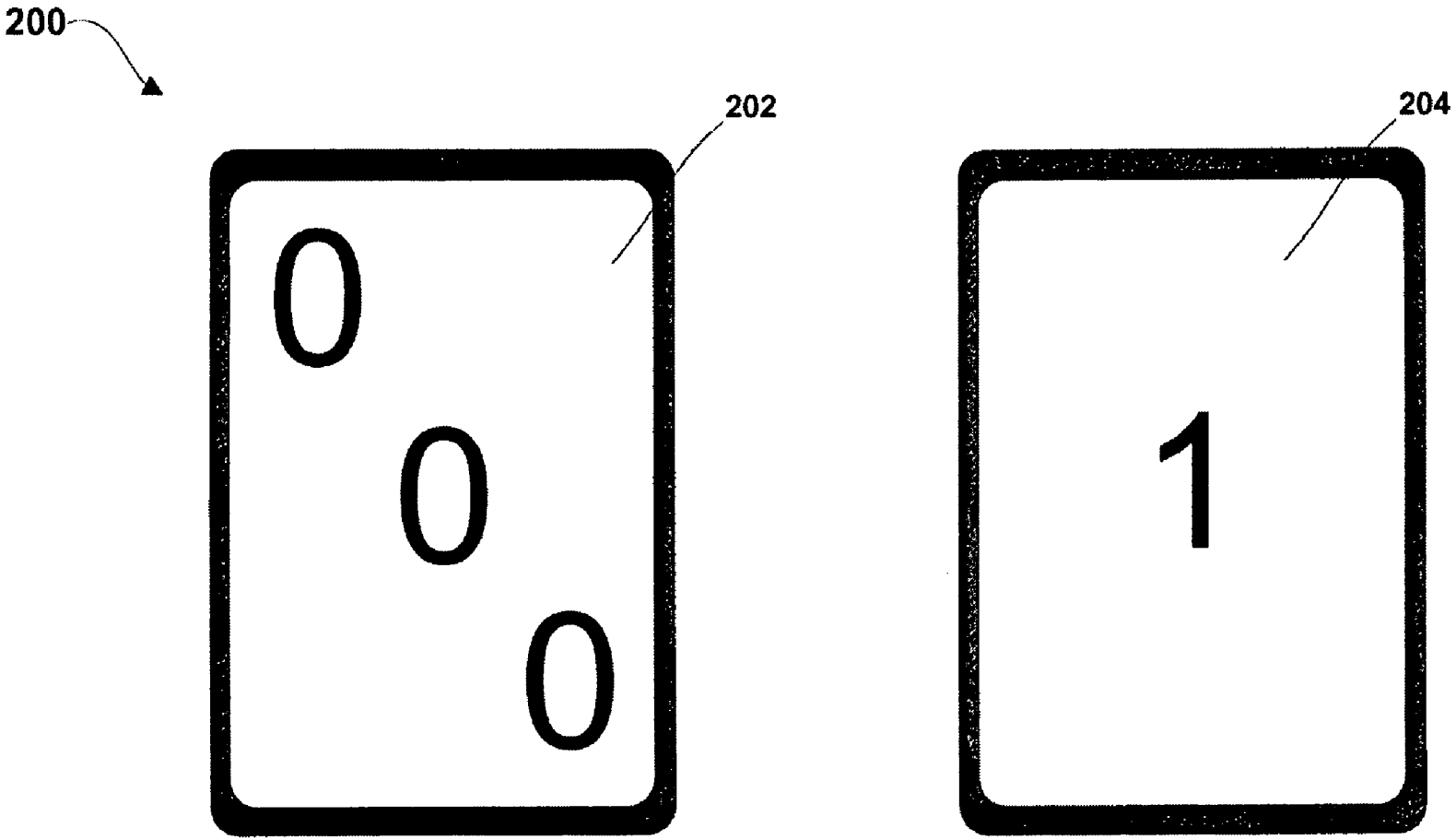
FIG. 2 is a diagram of one card of the card game shown in FIG. 1.

FIG. 2 shows a diagram of an exemplary card 200 of the card game 100. The card 200 includes a top side 202 and a face side 204. The face side 204 includes an indication of the distinct number as described above. Generally each card 200 is dealt to the players with the top side 202 up, i.e., "face down." However in some embodiments of the card game 100, one or more of the cards may be dealt "face up."

Figure 3:
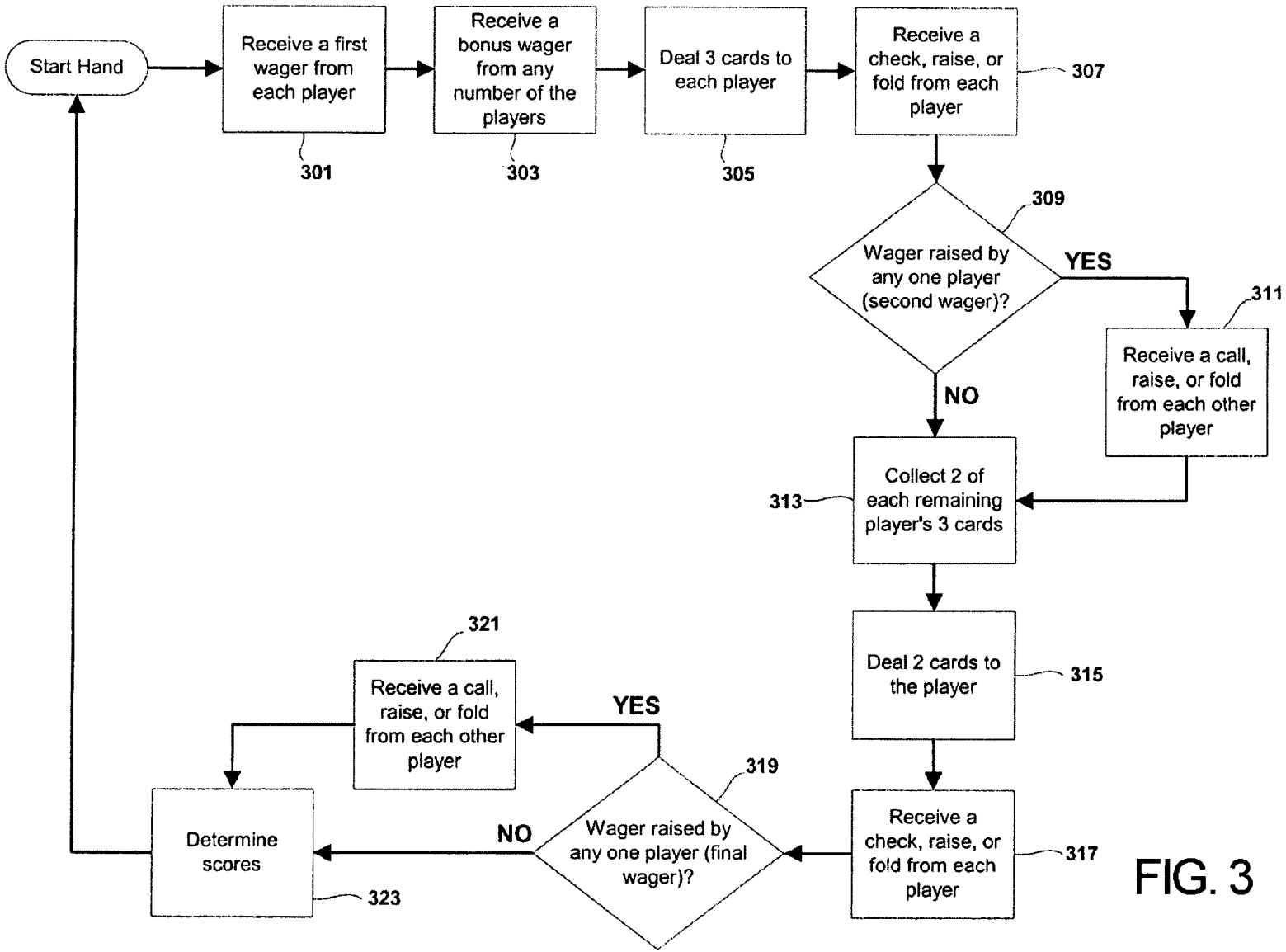
FIG. 3 is a method of playing the card game shown in FIG. 1.

FIG. 3 shows a method 300 of playing the card game 100. The method 300 is described with respect to the sets and cards shown in FIGS. 1-2. However, one of ordinary skill in the art will understand that the method 300 may be implemented using any other similar playing cards. For example, the method 300 may be employed with a deck of three like sets of seventeen numbered cards as described above. The method 300 may also be implemented using a deck in which each null card includes any zero-valued symbol or marking other than the number zero (e.g., a shape, a color, etc).

The method 300 describes one hand (and/or round) of the card game 100. The card game 100 is preferably played in a series of hands and any number of hands may be played. For example, players of the card game 100 may designate a set number of hands. Alternatively, the players may play until one player reaches a designated prize or wager value (e.g., dollar value or point value).

As will become clear upon reading the following, a given hand of the card game 100 has several objects. For example, a player may be at least one of the winners of a given hand if he, at the end of the hand, has three numbered cards that sum to the lowest number as compared to the other players. A player may also be a winner if he ends up with three numbered cards that sum to the highest number. Further, a player may receive a progressive bonus pot if each of his numbered cards is a null card. Another player may receive a portion of the progressive bonus pot (e.g., 10%) if each of his numbered cards has the same number (e.g., three 5's).

The method 300 includes a first step 301 of receiving a first wager from each of a group of players (e.g., up to 8 players). The wagers may be received sequentially (e.g., in a predefined order or rotation) or simultaneously. The wager may be any type of wager, such as a chip, a point value, or a monetary bet. If, for example, the card game 100 is being played in a casino, the first wager may be a monetary value equal to or greater than a table minimum. Further, the steps of the method 300 may be performed by a dealer of the casino.

Next, any one of the players may optionally provide a bonus or three null (e.g., zero) card wager (step 303). The bonus wager may be provided to a progressive bonus pot. As one of ordinary skill in the art will understand, the bonus pot may increase in value until a player wins the bonus pot, i.e., carrying over to any number of hands and/or groups of players. A player need not provide a bonus wager. However, as is described in more detail below, a player generally may only win the bonus or three null card pot if he/she has provided a bonus wager in the given hand.

The method 300 further includes a step 305 of dealing (e.g., face down) three cards of the deck (i.e., comprising the three like sets of cards) to each player. The players may be dealt cards in any order, but preferably in a predefined order in which the player receiving the first dealt card changes between each given hand. Preferably the deck is shuffled periodically, e.g., between each game and/or at a set interval of time.

Each player may then view his cards and decide whether to raise the first wager (i.e., provide a second wager), "check," or "fold" (step 307). For example, each player may check and therefore no second wager is provided by any player. Alternatively, one or more players may choose to raise the first wager by providing a second wager. If a player raises, each other player must "call" (i.e., match the second wager) to remain in the hand (step 311). If a player does not call, that player must fold (i.e., withdraw from the hand forfeiting his first wager and/or bonus wager).

Next, two cards are collected from each of the players remaining in the hand (step 313). Each player chooses which of his two cards to discard. At this point, each player may decide what object of the hand they wish to pursue. For example, if a player has a "1" card, he may choose to discard his other two cards to attempt to end up with the lowest sum. Likewise, if a player has a "13" card, he may choose to discard his other two cards to attempt to end up with the highest sum.

If any one of the players is dealt a null card, he must decide whether to pursue a high/low sum win or the progressive bonus pot. A player of the card game 100 who ends up with one or two null cards at the end of a given hand generally may not be eligible for a low or high sum win. Therefore, the player who is dealt a null card must either discard it (in step 313) or retain the one null card in hopes of receiving two additional null cards and winning the progressive bonus pot.

In some embodiments, a player who is initially dealt three like cards (e.g., three null cards) may choose not to provide the two cards to the dealer in step 313. The player will be disqualified from collecting any of the regular wagers but will be awarded the progressive bonus pot (or a portion thereof) at the conclusion of the hand.

Each of the remaining players is then dealt two additional cards from the deck (step 315). At this stage in the hand, each player now has his final three cards of the hand. Next, any player may again choose to raise the wager (i.e., by providing a final wager), check or fold (step 317). If any player raises the wager, each other player must again call to remain in the hand (step 319-321).

Figure 4:
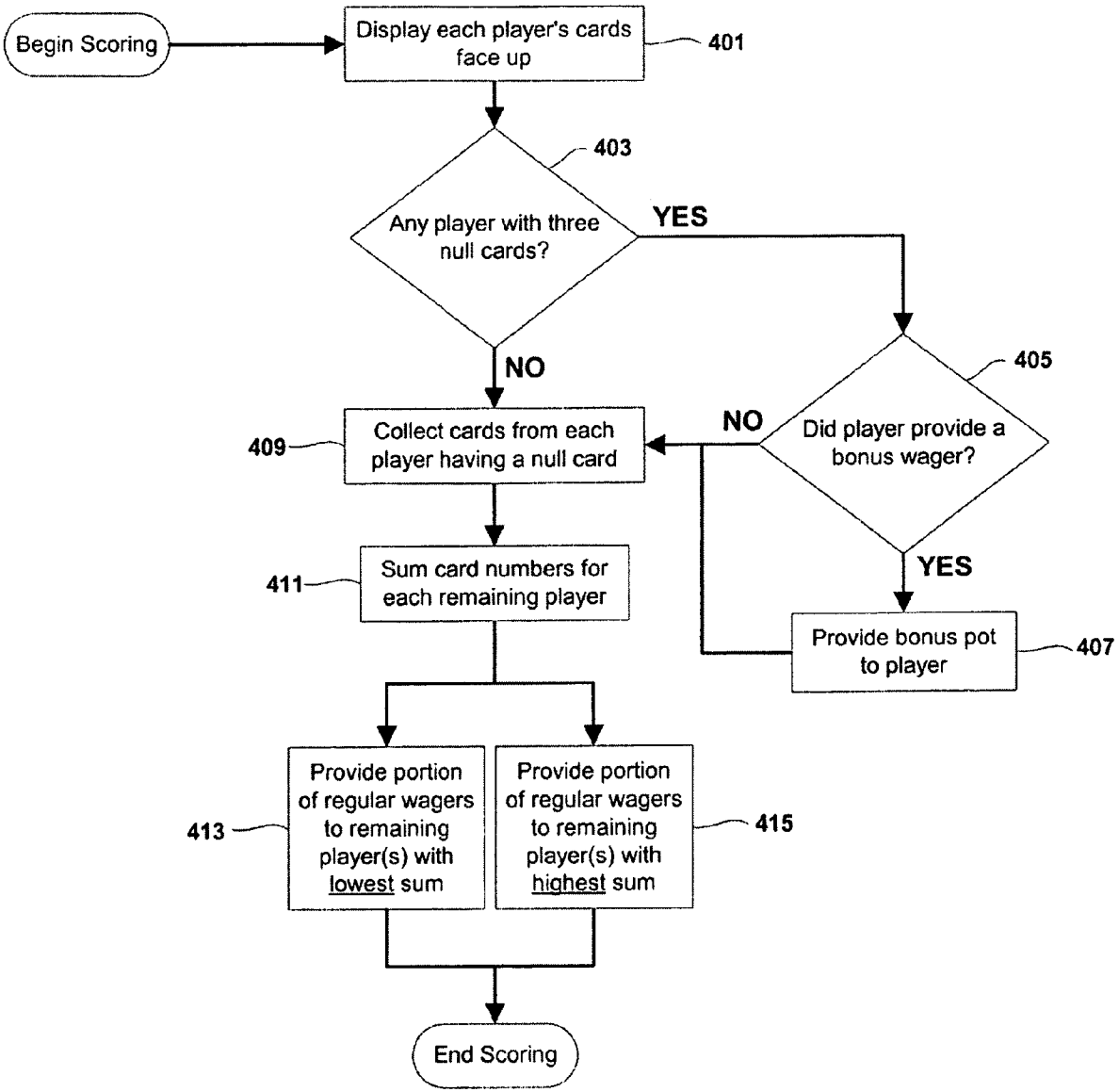
FIG. 4 is a method of scoring the card game shown in FIG. 1.

The final step of the method 300 is to determine the scores and/or winners of the particular hand (step 323). FIG. 4 shows a method 400 of scoring the card game 100. First, each player displays his three final cards, e.g., face up (step 401). If any one of the players has three null cards (step 403), he is provided with the progressive bonus pot only if he provided a bonus wager at the beginning of the hand (steps 405-407). If the player having three null cards did not provide a bonus wager, he does not win the bonus pot and is also not eligible to win a portion of the first and/or final wagers.

Generally, any player having one or more null cards is not eligible to the win the regular wagers and therefore his cards are collected/discarded (step 409). However, it should be noted that if every player but one folds, the remaining player will win all or a portion of the regular wagers regardless of whether he holds a null card. Therefore as one of ordinary skill in the art will understand, a player having a null card may continue playing a hand with the strategy of encouraging all other players to fold.

Figure 5:
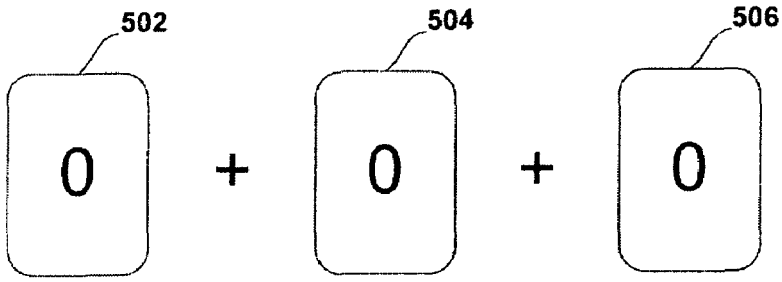
FIG. 5 is an exemplary hand of the card game shown in FIG. 1.
Figure 6:
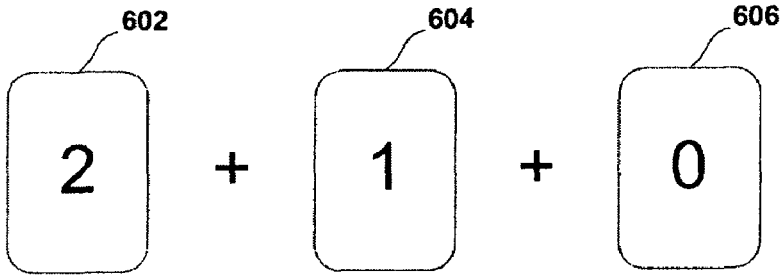
FIG. 6 is an exemplary hand of the card game shown in FIG. 1.

Next, a sum is determined for each of the remaining players (step 411). FIGS. 5-8 show several exemplary hands of the card game 100 to illustrate. FIG. 5 shows a hand having three null (e.g., zero) cards. If the player of this hand provided a bonus wager towards the beginning of the hand, the player will receive the bonus pot (e.g., progressive bonus pot). In FIG. 6, a hand is shown having one null card 606. A player of this hand will not will the bonus pot and also will not be eligible for either the high sum or low sum win (unless all other players fold).

Figure 7:
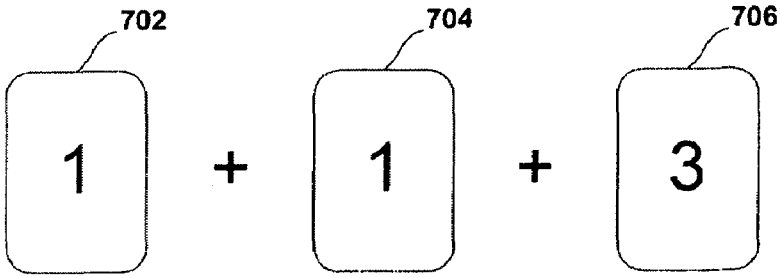
FIG. 7 is an exemplary hand of the card game shown in FIG. 1.

FIG. 7 shows an exemplary hand which may provide a player with the lowest sum. The sum of this hand is 5 and the player will win a portion of the regular (i.e., first, second, and final) wagers if no other player receives a lower sum (step 413 shown in FIG. 4). The portion may be any portion, but is preferably half of the total regular wagers in a given hand. It should be noted, however, that a player's winnings in a casino may additionally be reduced by any applicable casino or "house" commissions. Such commissions may be deducted from each player's wager (i.e., before being contributed to the regular and/or bonus pot), at the time of a payout (i.e., a percentage of winnings), or in any other manner adopted by the casino.

In some hands, it is possible that two or more players will tie for the lowest or highest sum. If this occurs, the portion is divided among the tied players. For example, two low sum winners may split half of the regular wagers (e.g., 25% each) while a single high sum winner receives half of the regular wagers (i.e., the remaining 50%).

Figure 8:
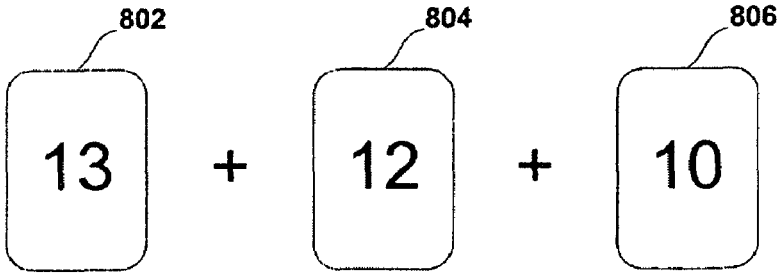
FIG. 8 is an exemplary hand of the card game shown in FIG. 1.

FIG. 8 shows an exemplary hand which may provide a player with the highest sum. The sum of this hand is 35. If no other player receives 35 or higher, the player of this hand will receive a portion of the given hand's regular (i.e., first, second, and final) wagers (step 415 shown in FIG. 4). Note that the bonus or three null card wagers are kept separately (i.e., in a progressive pot) and are not divided up after each hand, e.g., unless a player receives three null cards.

In some versions of the card game 100, a player who receives any three cards having the same number will be awarded a portion of the bonus pot. The portion may be any percentage (e.g., 10%) and/or fixed amount taken out of the bonus pot. If an additional subsequent player in a given hand also has three like cards, the subsequent player may receive the same portion or a lesser portion of the bonus pot. For example, a subsequent player in the same hand (e.g., later in a rotation) having three like cards may receive the percentage (e.g., 10%) of the remaining bonus pot after the first winner is paid (e.g., equal to 9% of original bonus pot).

The card game 100 and methods of the playing the same as described above may be played by a group of players at a common location (e.g., using tangible numbered cards). Alternatively, the card game 100 may be played by any number of players in remote locations to one another (e.g., using virtual cards). For example, the card game 100 may be implemented in software and/or played via a communications network, e.g., the Internet.

Although the invention has been described with reference to a particular arrangement of parts, features and the like, these are not intended to exhaust all possible arrangements or features, and indeed many modifications and variations will be ascertainable to those of skill in the art.

What is claimed is:

1. A method of playing a card game, comprising the steps of:

providing a deck including three like sets of numbered cards, each set including a null card;

receiving a first wager from each of a group of players;

dealing three cards of the deck to each player;

collecting two of each player's three cards;

dealing two cards of the deck to each player;

summing the numbers on the three cards for each player not holding a null card;

providing at least a portion of the wagers to each player having the lowest sum; and providing at least a portion of the wagers to each player having the highest sum.

2. The method according to claim 1, further comprising the step of:

providing a bonus to a player having three null cards.

3. The method according to claim 1, further comprising the steps of:

providing at least a portion of a bonus to a player having three cards with the same number.

4. A method of playing a card game, comprising the steps of:

providing a deck including three like sets of numbered cards, each set including a null card;

receiving a first wager from each of a group of players;

dealing three cards of the deck to each player;

collecting two of each player's three cards;

dealing two cards of the deck to each player;

receiving a final wager from one or more of the group of players;

discarding the three cards of each player not providing the final wager;

summing the numbers on the three cards for each remaining player not holding a null card;

providing at least a portion of the wagers to each remaining player having the lowest sum; and providing at least a portion of the wagers to each remaining player having the highest sum.

5. The method according to claim 4, further comprising the step of:

providing a bonus to a player having three null cards.

6. The method according to claim 4, further comprising the steps of:

providing at least a portion of a bonus to each player having three cards with the same number.

7. A method of playing a card game, comprising the steps of:

providing a deck including three like sets of numbered cards, each set including a null card;

receiving a first wager from each of a group of players;

receiving a bonus wager for a progressive bonus pot from at least one of the group of players;

dealing three cards of the deck to each player;

collecting two of each player's three cards;

dealing two cards of the deck to each player;

summing the numbers on the three cards for each player not holding a null card;

providing at least a portion of the first wagers to each player having the lowest sum; and providing at least a portion of the first wagers to each player having the highest sum.

8. The method of claim 7, further comprising the step of:

providing the bonus pot to the player having three null cards if the player provided a bonus wager.

9. The method according to claim 7, further comprising the steps of:

providing at least a portion of the bonus pot to each player having three cards with the same number.

10. The method according to claim 7, wherein each of the three like sets of numbered cards in said step of providing a deck includes fourteen numbered cards, each card having a distinct number between zero and thirteen, inclusive.

11. The method according to claim 10, wherein the group of players consists of up to eight players.

12. The method according to claim 7, wherein each of the three like sets of numbered cards in said step of providing a deck includes seventeen numbered cards, each card having a distinct number between zero and sixteen, inclusive.

13. The method according to claim 12, wherein the group consists of up to 10 players.

14. A method of playing a card game, comprising the steps of:

providing a deck including three like sets of numbered cards, each set including a null card;

receiving a first wager from each of a group of players;

receiving a bonus wager for a progressive bonus pot from at least one of the group of players;

dealing three cards of the deck to each player;

receiving a second wager from one or more of the group of players;

discarding the three cards of each player not providing the second wager;

collecting two of each of the remaining player's three cards;

dealing two cards of the deck to each of the remaining players;

receiving a final wager from one or more of the remaining players;

discarding the three cards of each remaining player not providing the final wager;

summing the numbers on the three cards for each remaining player not holding a null card;

providing at least a portion of the first, second, and final wagers to each remaining player having the lowest sum; and providing at least a portion of the first, second, and final wagers to each remaining player having the highest sum.

15. The method of claim 14, further comprising the step of:

providing the bonus pot to the player having three null cards if the player provided a bonus wager.

16. The method according to claim 14, further comprising the steps of:

providing at least a portion of the bonus pot to each player having three cards with the same number.

17. The method according to claim 14, wherein the group of players consists of up to eight players.

18. The method according to claim 14, wherein the group consists of up to 10 players.

19. A method of playing a card game, comprising the steps of:

providing a deck including three like sets of numbered cards, each set including a null card;

dealing three cards of the deck to each of a group of players;

collecting two of each player's three cards;

dealing two cards of the deck to each player; and summing the numbers on the three cards for each player not holding a null card;

providing a portion of a prize to each player having the lowest sum; and providing a portion of the prize to each player having the highest sum.

20. The method according to claim 19, further comprising the step of:

providing a portion of a bonus prize to a player having three cards with the same number.

21. The method according to claim 19, further comprising the step of:

providing a bonus prize to a player having three null cards.

22. A method of playing a card game, comprising the steps of:

providing a deck including at least four like sets of numbered cards, each set including a null card;

receiving a first wager from each of a group of players;

dealing at least four cards of the deck to each player;

collecting at least two of each player's three cards;

dealing at least two cards of the deck to each player;

summing the numbers on the at least four cards for each player not holding a null card;

providing at least a portion of the wagers to each player having the lowest sum; and providing at least a portion of the wagers to each player having the highest sum.

* * * * *